United States Patent [19]

Sickinger et al.

[11] 4,143,686

[45] Mar. 13, 1979

[54] COIL BINDING MACHINE

[75] Inventors: Albert E. Sickinger, Bloomfield Hills; Thomas G. Lhota, Lake Orion, both of Mich.

[73] Assignee: Hans Sickinger Co., Pontiac, Mich.

[21] Appl. No.: 877,233

[22] Filed: Feb. 13, 1978

[51] Int. Cl.[2] ..... B21F 15/00

[52] U.S. Cl. ..... 140/92.93; 140/92.3

[58] Field of Search ..... 140/92.3, 92.93, 92.94; 11/1 R, 1 A, 1 C, 1 CA; 269/79, 81, 82, 83

[56] References Cited

U.S. PATENT DOCUMENTS

| | | | |
|---|---|---|---|
| 2,808,079 | 10/1957 | Tauber | 140/92.3 |
| 2,963,946 | 12/1960 | Muench | 269/82 |
| 3,826,290 | 7/1974 | Pfaffle | 140/92.3 |

*Primary Examiner*—Lowell A. Larson

*Attorney, Agent, or Firm*—Harness, Dickey & Pierce

[57] ABSTRACT

An improvement in coil binding machines of the type having front and rear clamps for the book spine during insertion of the spiral wire. The improved machine permits the book to be placed in position for clamping with the operator either sitting or standing, and with the book being inserted vertically, horizontally, or at any intermediate angular position. The invention comprises a pair of arcuate plates on opposite sides of the machine which support the coil binding mechanism therebetween and are rotatably adjustable so that the facing surfaces of the two clamps are either vertical, horizontal or angularly disposed. A table is secured adjacent the rear clamp so that the book may be placed thereon. The side plates are provided with locking means for their adjusted position.

6 Claims, 2 Drawing Figures

COIL BINDING MACHINE

BACKGROUND OF THE INVENTION

Field of the Invention

The invention relates to spiral binder applying machines such as those such as that disclosed in Ostermeier, U.S. Pat. No. RE 26,929 issued June 30, 1970. Such machines are used to insert spiral binders in perforated packs of sheets, and include front and rear clamps having facing surfaces between which the spine of the unbound pack is held. A coiling tool then feeds the spiral wire through the perforations, and the ends of the spiral are cut and bent inwardly. The clamps are then separated and the book removed.

2. Description of the Prior Art

In conventional coil binding machines of this type the rear clamp is fixed and the front clamp swings, the facing surfaces of the clamps being vertical. While the clamps are adjustable axially there is no provision in prior machines for preselecting the height or the angle at which the unbound book is inserted by the operator into position for clamping. The normal arrangement is such that the operator must be in a sitting position for insertion between the vertical faces of the clamps. It is known to have coil binding machines of this type with clamp faces horizontally disposed. Here again, however, the clamps are fixed and no adjustment in height or angle of book insertion is possible.

An industrial user of such machines will typically have orders for various sizes of books in terms of length and thickness. In some instances it is desirable that the operator stand when inserting the books for binding. This is true for example when relatively long sheet groups are involved such as large calendars. Also, in some instances the coil binding machine is placed next to a hole punching machine in which case it is more convenient for the operator to be in a standing position when receiving sheet groups from the punching machine to be placed in the binding machine. To do this, the clamps should be relatively high with their facing surfaces horizontal. For thick books however a horizontal position is unsatisfactory since it is necessary to hang such thick sheet groups on curved hooks in order to shape the holes for receiving the spiral wire. This would require clamp faces in a vertical position.

BRIEF SUMMARY OF THE INVENTION

It is an object of the present invention to provide a novel and improved coil binding machine which overcomes the disadvantages of previous machines having fixed clamp positions, and enables the operator to preselect both the height and angle of insertion of the unbound sheet groups being placed into clamping position.

It is another object to provide an improved coil binding machine of this nature which is simple in character, economical to construct and reliable in use.

Briefly, the invention comprises a coil binding machine having a fixed rear clamp, a movable front clamp, said clamps having facing surfaces for gripping a sheet group therebetween, a coiling tool adjacent one end of said clamps, means for driving said coiling tool, means for moving front clamp between unclamping and clamping positions, a pair of arcuate plates on opposite sides of said machine, said clamps, coiling tool, driving means and moving means being mounted between said plates, means supporting said plates for rocking movement, a fixed frame carrying said plate supporting means, means securing said plates together for movement in unison, said clamps being spaced from the central axis of said plates whereby rocking of said plates will change the height of said clamps and the angle of their facing surfaces, and means securing said plates in their arcuately adjusted position.

DESCRIPTION OF THE PREFERRED EMBODIMENT

Figure 1:
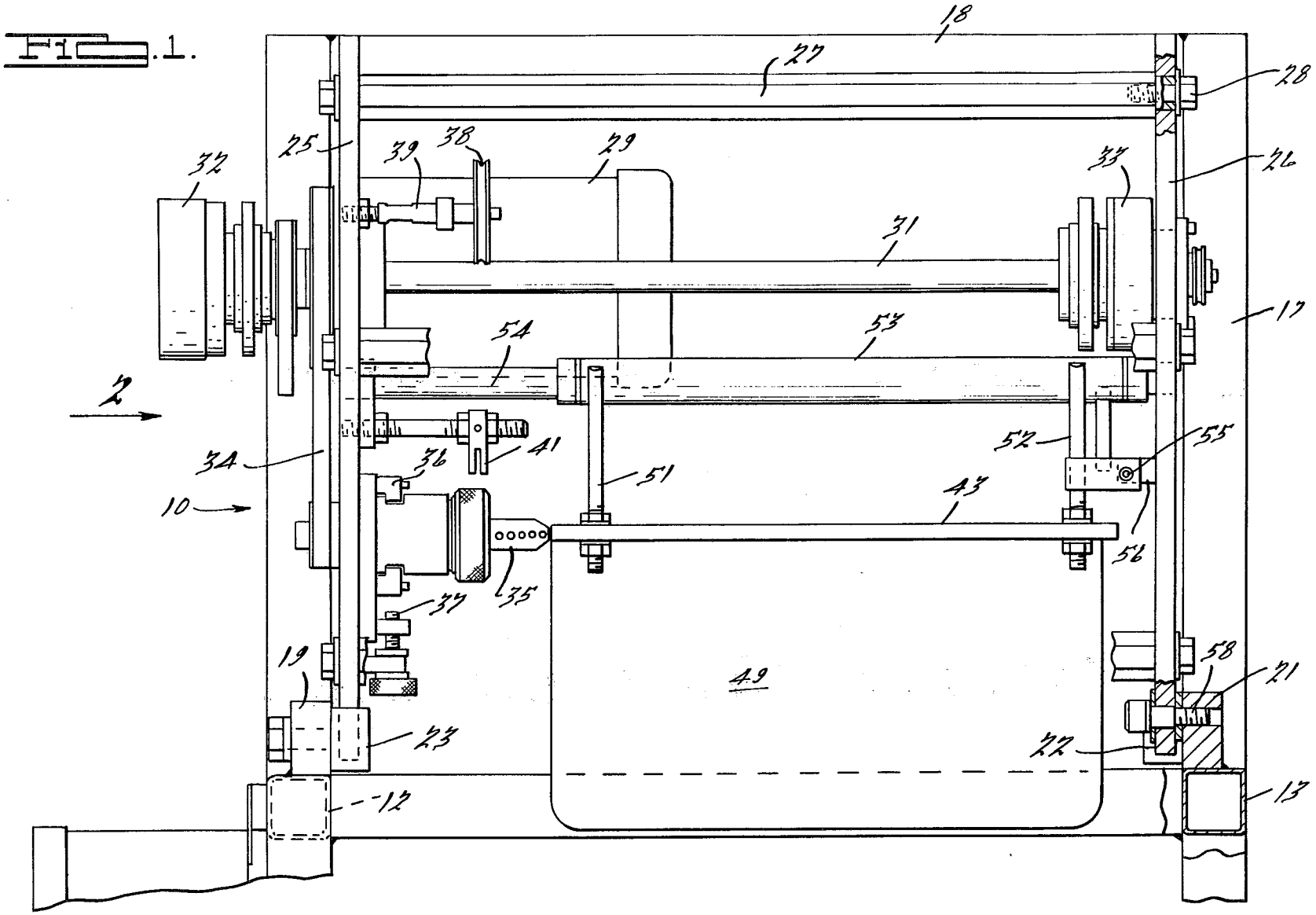
FIG. 1 is a front elevational view of a coil binding machine incorporating the principles of this invention.

The coil binding machine is generally indicated at 10 and comprises a fixed frame generally indicated at 11 having horizontal side members 12 and 13, a rear member 14 and legs 15 and 16, the latter extending upwardly beyond member 14 as indicated at 17 and being connected by a top member 18. The height of members 12, 13 and 14 is preferably convenient for an operator who is sitting in front of machine 10.

A pair of roller supporting members 19 and 21 are mounted on side members 12 and 13 respectively. Each member 19 and 21 carries a pair of rollers 22 and 23 on its inside, roller 23 being spaced forwardly from roller 22 with the rollers mounted on horizontal axes 24. A pair of arcuate or circular plates 25 and 26 rest on the pairs of rollers 22 and 23. These plates are of sufficient thickness and strength to carry the working components of coil binding machine 10. The plates are on opposite sides of the machine and are held together by a plurality of spacers such as that indicated at 27 which are secured to the plates by bolts 28.

Many of the parts which are mounted between plates 25 and 26 need not be described in detail since they are similar to components in the above mentioned patent for clamping an unbound sheet group in binding position and feeding a spiral wire into the sheet group perforations. For example, a driving motor 29 is mounted on plate 25 and drives a shaft 31 on the axis of which is mounted a clutch 32 and a brake 33. This shaft is connected by a belt 34 to a coiling tool 35, the latter being adjustably mounted on plate 25 by means of clamps 36 and adjusting screw 37. The wire (not shown) is fed from a supply source over a pulley 38 carried by a post 39 secured to plate 25, and then through a guide 41 which is also secured to plate 25, passing from there to the coiling tool.

A fixed rear clamp 42 and a movable front clamp 43 are also disposed between plates 25 and 26. These clamps are for an unbound group of sheets indicated schematically in dot-dash lines at 44 in FIG. 2. The clamps may vary in construction and shape with the illustrated rear clamp 42 in FIG. 2 having a spiral wire guide roller 45 mounted therein. The two clamps have facing surfaces between which book 44 will be held so that the spiral wire binder 46 may be inserted therein by coiling tool 35.

Rear clamp 42 is mounted on a flat member 47 which in turn is secured to a platform 48, the clamp being adjustable longitudinally in accordance with the particular binder and book involved. A table 49 is secured to member 47 and extends downwardly therefrom substantially in line with the surface of clamp 42 which faces clamp 43. This table is for the purpose of aiding the operator when an unbound book 44 is being placed in position for clamping between members 42 and 43. It should be noted that the location of this clamping is a substantial distance from the central axis of side plates 25 and 26 so that rocking movement of these side plates will change both the angular position and height of the clamps and of table 49.

Front clamp 43 is carried by the lower ends of pair of rods 51 and 52, the upper ends of these rods being secured to a sleeve 53. This sleeve is rotatably mounted on a shaft 54 which extends between and is secured to plates 25 and 26. As described in detail in the aforementioned patent, means are provided for swinging sleeve 53 and therefore clamp 43 between clamping and unclamping positions, the clamping position being adjustable by a screw member 55 which engages a stop 56. As shown, the mechanism for operating clamp 43 is all mounted between side plates 25 and 26 and will therefore move with the plates.

The means for securing plates 25 and 26 in their angularly adjusted position comprises an arcuate slot 57 in each of the plates and a bolt 58 extending through each slot and threadably mounted in the member 19 or 21 which carries the plate supporting rollers. As seen in FIG. 1, tightening of bolt 58 will clamp its respective plate 25 or 26 in tight frictional engagement with the adjacent member 19 or 21.

In operation, the operator will first preselect the angular position and height which is desired for the book handling operation. If it is desired to place the books between the clamps in a raised and horizontal position the plates and their attendant mechanism will be rotated counterclockwise in FIG. 2 to the full extent permitted by slots 57. At that point, table 49 will be in the uppermost position as shown by the dot-dash lines 49*a* in FIG. 2 and clamps 42 and 43 will also be raised with their facing surfaces horizontal. When in this position, the operator will usually be standing and will place each unbound group of sheets on table 49 in position 49*a* with clamp 43 in its unclamping position. The mechanism will then be operated in the normal manner and the book removed thereafter.

Figure 2:
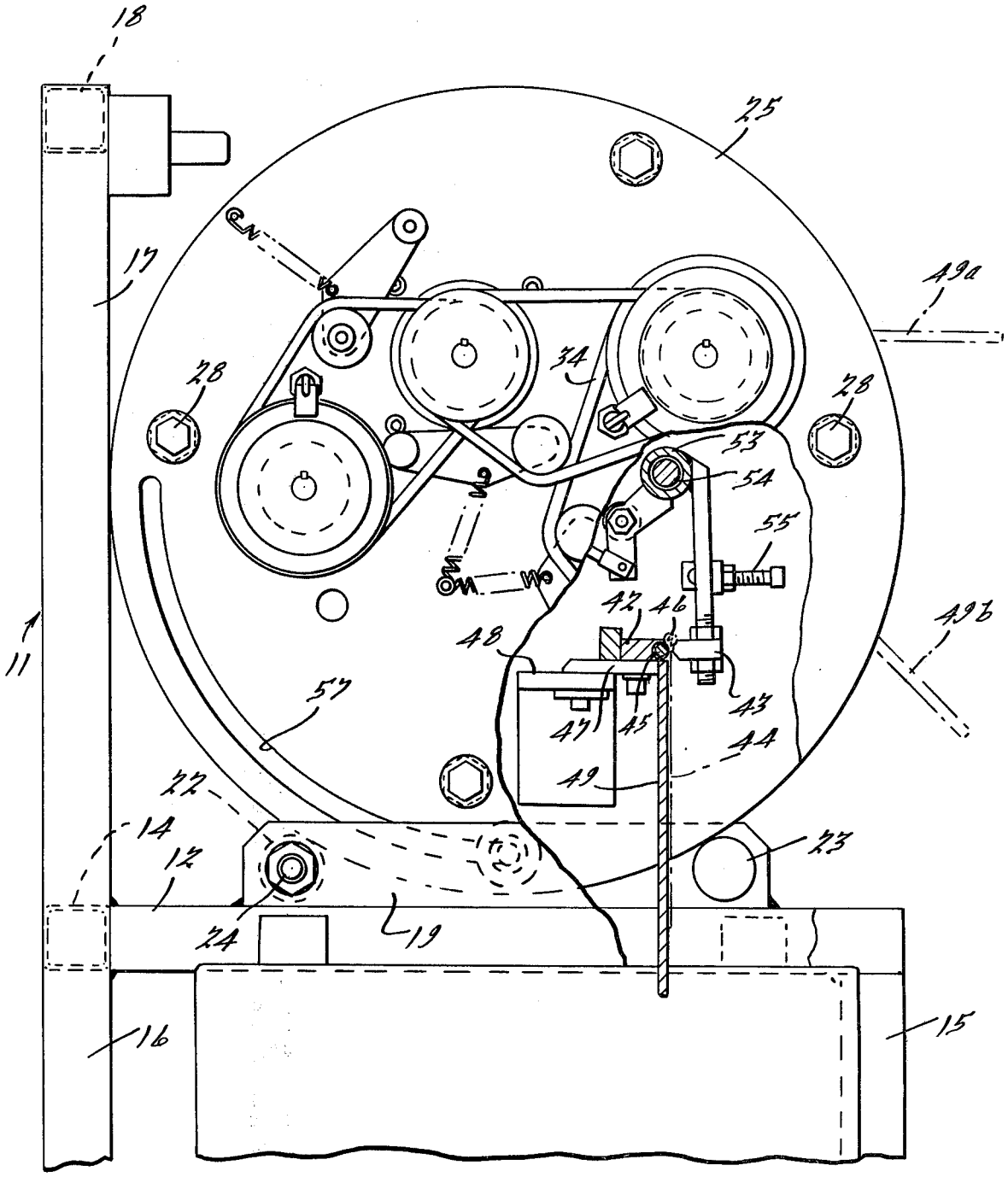
FIG. 2 is a partially sectioned side elevational view taken in the direction of the arrow 2 of FIG. 1 and showing further details of the invention.

If the operator desires to place sheet groups 44 in clamping position when sitting down and with sheet groups vertical, the plates will be rotated to the FIG. 2 position. If an intermediate composition is desired as indicated by the dot-dash lines 49*b* the plates will be adjusted accordingly. In each case the plates will be held in position by tightening clamping bolts 58.

While it will be apparent that the preferred embodiment of the invention disclosed is well calculated to fulfill the objects above stated, it will be appreciated that the invention is susceptible to modification variation and change without departing from the proper scope or fair meaning of the subjoined claims.

We claim:

1. A coil binding machine comprising a fixed rear clamp, a movable front clamp, said clamps having facing surfaces for gripping a sheet group therebetween, a coiling tool adjacent one end of said clamps, means for driving said coiling tool, means for moving said front clamp between unclamping and clamping positions, a pair of arcuate plates on opposite sides of said machine, said clamps, coiling tool, driving means and moving means being mounted between said plates, means supporting said plates for rocking movement, a fixed frame carrying said plate supporting means, means securing said plates together for movement in unison, said clamps being spaced from the central axis of said plates whereby rocking of said plates will change the height of said clamps and the angle of their facing surfaces, and means securing said plates in their arcuately adjusted position.

2. The combination according to claim 1, said plate supporting means comprising two rollers under each plate.

3. The combination according to claim 1, further provided with a table secured between said plates for supporting a sheet group to be clamped, said table being substantially aligned with the clamping surface of said rear clamp, whereby rocking adjustment of said plates will adjust the angle of repose of said table.

4. The combination according to claim 3, said plates being movable between a first position in which said table is substantially horizontal and a second position in which said table is substantially vertical.

5. The combination according to claim 1, said securing means comprising an arcuate slot in at least one of said plates and a fastener extending through said slot and threadably mounted on said frame.

6. The combination according to claim 1, said plates being circular, said plate supporting means comprising a pair of rollers under each plate, said plate securing means comprising a fastener extending through an arcuate slot in at least one of said plates and threadably mounted on said frame, and a sheet group supporting table secured between said plates and substantially aligned with the clamping surface of said rear clamp.

* * * * *